United States Patent [19]

Parker et al.

[11] 4,140,565

[45] Feb. 20, 1979

[54] METHOD FOR MOUNTING PHOTOGRAPHS INTO ALBUMS

[76] Inventors: Ben Parker; James Parker, both of 7200 Highway 50 East, Carson City, Nev. 89701

[21] Appl. No.: 565,666

[22] Filed: Apr. 7, 1975

[51] Int. Cl.[2] ..... B31F 7/00; G09F 1/10

[52] U.S. Cl. ..... 156/219; 40/154; 40/158 B; 281/22; 156/227; 156/291

[58] Field of Search ..... 40/154, 158 R, 158 B, 40/159, 104.17, 104.19, 102, 104.08, 104.09, 104.06; 281/22; 156/216, 219, 220, 227, 256, 291, 313, 477 B

[56] References Cited

U.S. PATENT DOCUMENTS

| | | | |
|---|---|---|---|
| 278,202 | 5/1883 | Thorp | 281/22 |
| 335,683 | 2/1886 | Chapman | 281/22 |
| 872,547 | 12/1907 | Uffner | 281/22 |
| 1,232,898 | 7/1917 | Dawson | 40/104.19 |
| 1,548,751 | 8/1925 | Russell | 40/104.09 |
| 1,549,389 | 8/1925 | Simon | 40/102 |
| 2,963,809 | 12/1960 | Parker | 40/104.07 |
| 3,642,552 | 2/1972 | Sibley | 156/216 |
| 3,792,544 | 2/1974 | Foley | 40/102 |
| 3,793,758 | 2/1974 | Feldhusen et al. | 40/102 |
| 3,822,495 | 7/1974 | Ohfuji | 40/158 R |
| 3,855,033 | 12/1974 | Staats | 156/220 |
| 3,869,820 | 3/1975 | Holson | 40/104.19 |
| 3,900,642 | 8/1975 | Michel | 156/291 |

*Primary Examiner*—Douglas J. Drummond
*Attorney, Agent, or Firm*—Herbert C. Schulze

[57] ABSTRACT

This invention is a new and unique method and means for the mounting of photographs wherein special embossing and mounting techniques, including special adhesive methods and means are employed so that the album properly maintains its shape with or without photographs mounted upon the special pages utilized, and wherein the techniques include removability features without affecting the uniformity of the thickness of the album, with or without pictures, and wherein special techniques are utilized to provide dual mounting of photographs on opposite sides of specially formed double mounting pages.

6 Claims, 12 Drawing Figures

METHOD FOR MOUNTING PHOTOGRAPHS INTO ALBUMS

CROSS REFERENCE TO RELATED PATENT APPLICATIONS

There are no related patent applications filed by us.

BACKGROUND OF THE INVENTION

1. Field of the Invention

This invention is in the general field of albums for the mounting of photographs and the like, and is more particularly directed to a new, improved, and unique method for forming photo albums comprising a plurality of pages, and to the said album and pages, wherein photographs are caused to be mounted and maintained in a flat condition and wherein the album itself is constructed of pages so designed and mounted as to insure that the album at all times will remain in a uniform thickness, even when completely filled with pictures.

2. Description of the Prior Art

There have been many attempts to provide satisfactory photo mounting albums wherein the mounting of the pictures will not disturb the uniformity and thickness of the album as a whole. Such attempts have included spacers between pages mounted within a cover, perforated alternate sheets which may be removed as photos are mounted to provide the equilibrium of the album, and other such means. Additionally, there is prior art in means to mount photographs in such manner that they will not curl; the outstanding example is the means of U.S. Pat. No. 2,963,809, issued to one of us, and there are such devices as "art corners" and the like, which have been utilized to attempt to hold pictures in a flat condition within a photo album.

There is no prior art, however, in the method of forming albums, and the albums and pages thus formed and utilized, wherein customary spacers are not used; and wherein the desired end includes special construction of the pages by embossing and combinations with special folding provides for the mounting of photos in the most economical and generally usable condition; and wherein appropriate adhesive means are provided for use by professionals and amateurs alike; and wherein the album may be so formed (either as a unit or by the addition of pages) that no special spacers or the like are required to maintain uniformity thereof.

SUMMARY OF THE INVENTION

In the photographic industry, one of the most troublesome aspects, particularly for amateur photographers, has been the problem of mounting of photographs within albums.

We have studied this problem for many years, and previously, one of us has made a substantial advance in the art as is represented by U.S. Pat. No. 2,963,809. Since that time, however, we have conducted further study, experimentation, and development and have now conceived and reduced to practice a unique method, and the necessary materials for practicing such method, by which amateurs or professionals alike are enabled to form economical and satisfactory mounting pages and albums for photographs.

The methods we have now developed include methods by which photographs may be individually mounted on pages separate and distinct from the completed album itself and placed within appropriate album covers in an unusual and unique manner so as to form desired albums which are of uniform thickness and may be used and formed with ease.

We have accomplished this by preparing certain special pages wherein, by unique folding methods at the mounting edge, and by special embossing and the like, the photographs may be mounted onto the pages with ease, and be mounted permanently, or removably, in such manner that the thickness of the album remains uniform; and, so that, when completely filled, the album remains a uniform thickness corresponding to that of its binding edge.

The means we have employed to accomplish this may be generally stated to include specially formed pages with embossed areas to form a "frame" about each picture, and wherein each such page is provided with appropriate spaced binding arrangements with relation to succeeding pages in such manner that the thickness of the photo within the embossed area remains constant with reference to the binding edge.

We have developed this general method and have been able to provide a number of unique embodiments of pages to accomplish the method. Among other things we have provided an embossed page for practicing this method wherein one photo, or a plurality, may be mounted on one side of a page, or, two or more photos may be mounted back to back on a page.

We have further provided such an embossed page wherein there are specially cut and formed corners within the embossing for holding the photos, with, or without, adhesives to assist in the holding. Another embodiment provides the appropriate alignment for utilization of double adhesive tape to be placed within a double page especially folded so as to enable the mounting of two photographs back to back upon the one adhesive. Another arrangement includes a special adhesive backed, double folded, page wherein the double fold is so adapted as to allow for the adhesion of such page to a tab within an album binding. Another variation is wherein a special double folded page arrangement is used and in which sections are cut out so as to match with suitable tabs within an album cover and to be held in place by a simple strip of paper or the like.

It is to be noted that the embossing now provides, for the first time in a usable album, an easy means for proper alignment of photos, which are generally available in a few standard sizes, and therefore a few standard embossed areas will allow easy and proper alignment within the album. Further, many photos are now being supplied in a borderless print, and the embossed area now makes a more pleasing view since it provides a frame for such borderless prints.

It is an object of this invention to provide a method for the mounting of photographs within album pages wherein the album will maintain a thickness equal to that of the binding when fully filled with photographs.

Another object of this invention is to provide an embossed photo album page wherein the photo albums may be held in position by a heat sealing adhesive.

Another object of this invention is to provide such an embossed page wherein the photographs are held in position by adhesive strips within the page.

Another object of this invention is to provide such an embossed page wherein special corner cuttings are provided to enable the corners of a photograph to be held in position, with, or without, the further addition of an adhesive material behind the photo.

Another object of this invention is to provide such an embossed page as heretofore described wherein photos with adhesive on their reverse side may be easily mounted in proper alignment upon the album page.

Another object of this invention is to provide such an embossed page wherein the page has cut-out areas in such manner that cellulose adhesive tape or the like may be placed over it with adhesive areas available through such cut-out portions as to allow the photos to adhere thereto when applied to the page.

Another object of this invention is to provide such a page as described immediately above, wherein the page is double folded and wherein double adhesive sided tape may be used to provide the adhesive areas through slots on both sides as well as for the purpose of holding the two sides of the double folded page together.

Another object of this invention is to provide such a page wherein there is an adhesive interior fold edge suitable to engage tabs upon an album cover.

Another object of this invention is to provide such pages having the double fold edge so arranged as to provide a series of tabs cooperatively arranged with relation to a series of engaging tabs upon an album cover in such manner as to be held in position by insertion of a strip of paper or the like through such tabs.

Another object of this invention is to provide such pages as heretofore mentioned, wherein a multiplicity of photos may be held, and wherein the page is so adapted that the multiplicity of photos may be loaded into a partially sealed page automatically after which the entire page is machine sealed to accomplish a permanent mounting.

Another object of this invention is to provide such pages as heretofore mentioned, wherein an embossed page provides proper framing for borderless photographs.

Another object of this invention is to provide an embossed frame area to fit standard size photoprints so that they may be properly aligned and held in position.

The foregoing and other objects and advantages of this invention will become clear to those skilled in the art upon reading the description of a preferred embodiment which follows, together with a review of the appended drawings.

DESCRIPTION OF A PREFERRED EMBODIMENT

Figure 1:
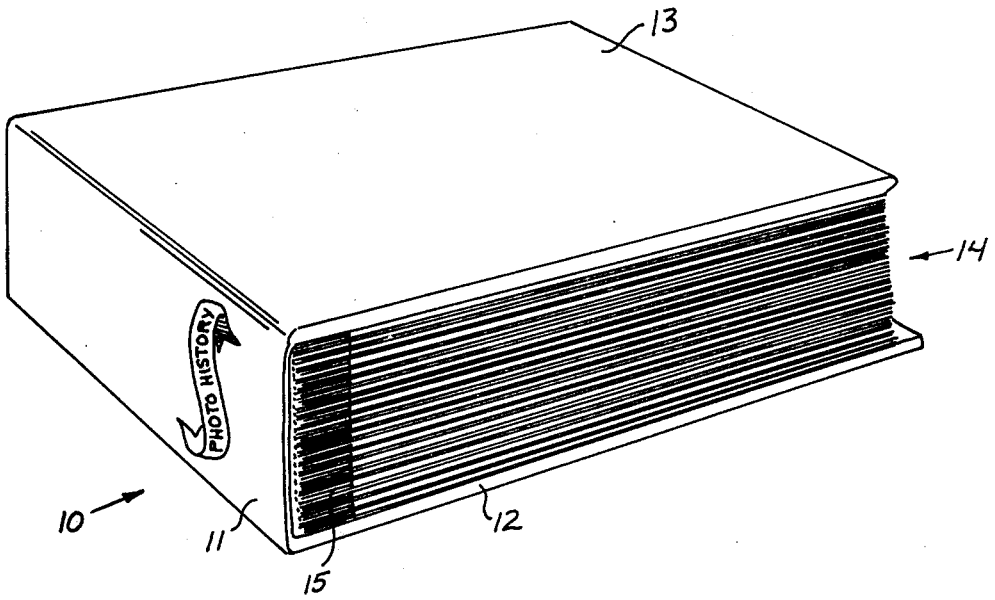
FIG. 1 is a perspective of a photo album utilizing the methods and means of this invention showing the appearance of such album when filled with photos.

FIG. 1 is merely a general illustration showing essentially the end result desired by the method of this invention. There is illustrated a photo album generally 10, having a back 11 and two covers 12 and 13. A plurality of pages 14 are bound at 15 in such manner that suitable thickness is provided between each pair of pages to enable the pages 14, when filled with photos, to still remain of such a uniform thickness that the covers 12 and 13 are essentially parallel and do not bulge from each other due to the filling with photographs, nor to have the pages so formed become bent, or otherwise deformed, nor to cause, nor allow, the photos to curl and bend within the album. Those skilled in the art know the problems in the prior art and the fact that such is almost universally true of photos within photo albums.

Figure 2:
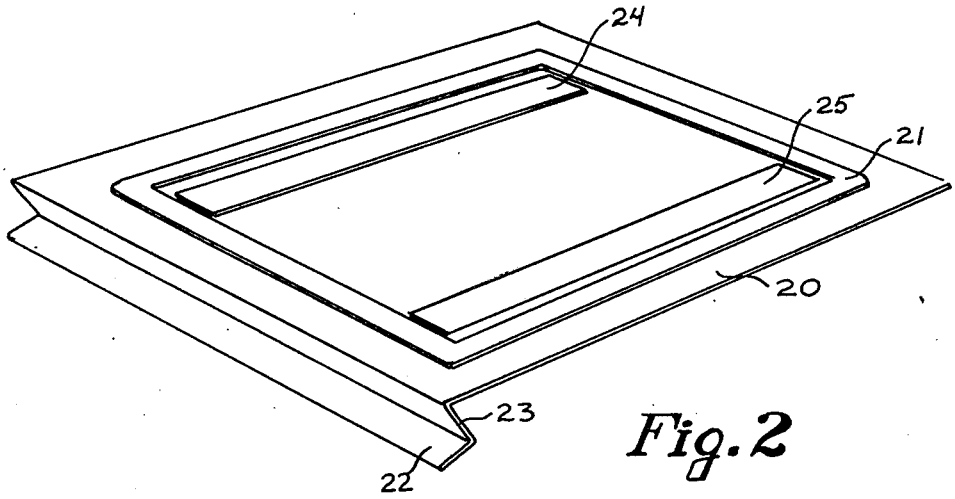
FIG. 2 is a perspective of a page suitable to practice the method of the invention for forming an album such as is shown in FIG. 1.

With attention turned particularly to FIG. 2 there is shown one page, 20 which can be utilized to form an album such as that shown in FIG. 1. It is to be understood that the pages generally on FIG. 1 are shown only by the numeral 14, since such pages can take alternative forms. A particular page 20 is shown in FIG. 2, and this page is shown to be formed of suitable paper for the page of an album, such paper being of sufficient body so as to enable the appropriate embossing 21. The embossing accomplishes a number of desired features. By this important advance, the embossing has a tendency to equalize the thickness of the page in conjunction with the special folding at 22 and 23 on a sheet of paper and in addition, provides a frame wherein the photo can be readily aligned by an amateur, which has generally not been possible in the past. Further, the embossing stiffens the page; and, it provides an excellent "frame" for borderless prints.

Those skilled in the art will understand that the embossing 21 may be formed by means of a press, and a pair of dies, wherein by pressure within such a press and two dies, a male on one side, and a female on the other, causing the embossed upstanding frame area 21 to be formed. That embossed frame area then is, in effect, a protrusion on one side and an indentation upon the other side of the page.

Figure 3:
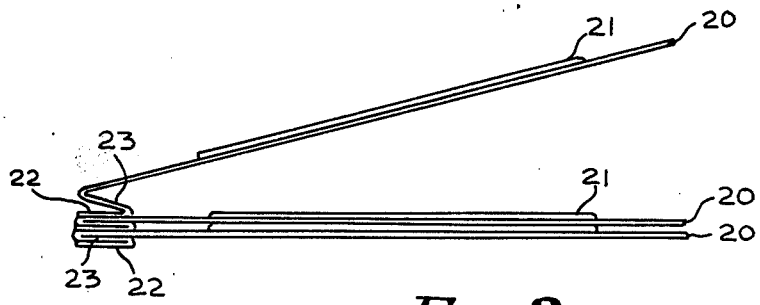
FIG. 3 is a section through a plurality of pages of the type shown in FIG. 2 illustrating the means by which appropriate spacing is accomplished.
Figure 2A:
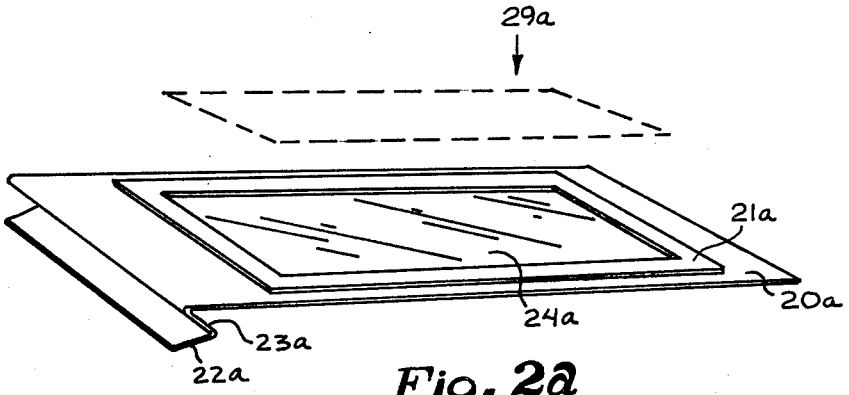
FIG. 2*a* is a perspective of an alternate embodiment of a page suitable to practice the method of the invention for forming an album such as is shown in FIG. 1.
Figure 2B:
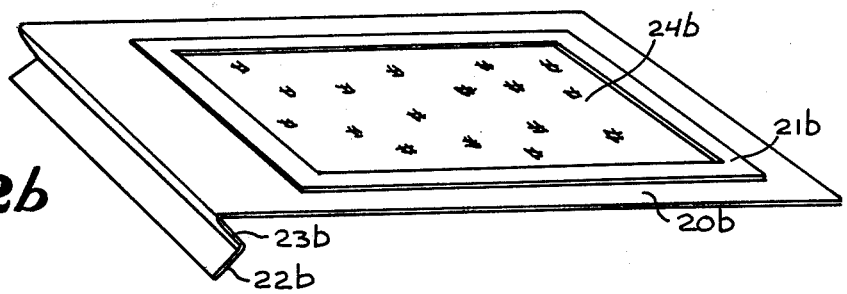
FIG. 2*b* is a perspective of another embodiment of a page suitable to practice the method of the invention for forming an album such as is shown in FIG. 1.
Figure 2C:
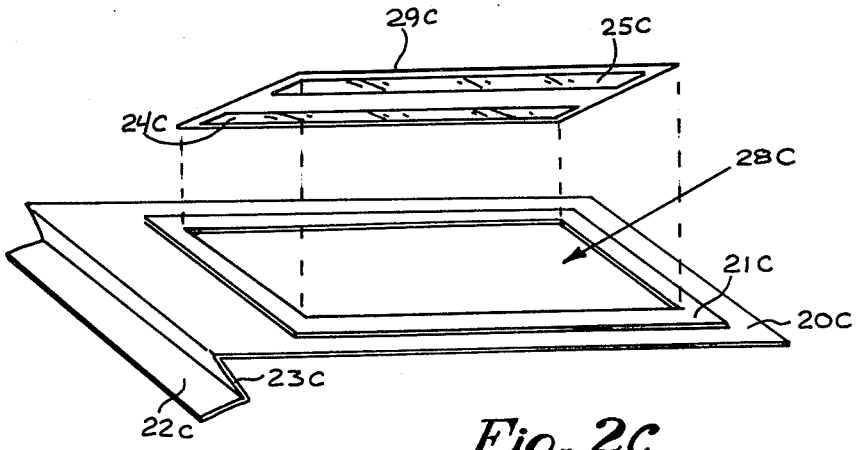
FIG. 2*c* is another alternate embodiment of a page suitable to practice the method of the invention for forming an album such as is shown in FIG. 1.

One edge of the page is double folded at 22 and 23 as illustrated so that when bound, the double thickness 22 and 23 is such that it equals the embossed area 21 in thickness and thus the thickness of the embossed area 21 on one page is offset and counteracted by the double thickness in the binding area on the succeeding page, as will be clear from the illustration of FIG. 3.

A multiplicity of such pages may be bound by customary binding means such as adhesive, or other binding means known to those skilled in the art. The result of using such pages will be an album having uniform thicknesses as indicated in FIG. 1.

In order properly to hold the photos in position upon each of the pages 20 when this embodiment is used, adhesive strips 24 and 25 may be utilized within the embossed area. These may be of the type customarily known in the trade where a paper backing is peeled from the strip to expose the adhesive surface when it is desired to use it; the photo is then pressed, within the embossed area, against the adhesive thus exposed.

Additionally, alternative forms of this page may be as shown in FIGS. *2a, 2b,* and *2c* wherein different adhesive methods are shown.

The embodiment shown in FIG. *2a* comprises the basic page 20*a* having the embossed area 21*a* and the folded binding edge 22*a* and 23*a*. Appropriate adhesives, such as a heat seal adhesive applied to a glassine material 24*a* affixed within the embossed area, or the like, is shown. The photo is placed in the manner as shown essentially by the phantom lines and the general reference 29 so as to appropriately contact such adhesive surface.

FIG. *2b* shows an alternative form wherein the page 20*b* having embossing 21*b* and the folded binding edge 22*b* and 23*b* has placed within the embossing a speckling throughout of an appropriate heat sealing adhesive, or other adhesive material 24*b*.

Another embodiment of this page can consist of the basic page 20*c* having the folded binding edge 22*c* and 23*c* together with the embossed area 21*c*. In this case, the area generally 28*c* within the embossing has no adhesive. In such instance, this page is ideally suited to receive photos, as they are sometimes now supplied from photo finishers, with adhesive strips already placed upon their reverse side. The reverse side of such a photo is illustrated at 29*c*, carrying strips of adhesive material 24*c* and 25*c* suitable so that the photo may be pressed in position as indicated within the area 28*c*.

Figure 4:
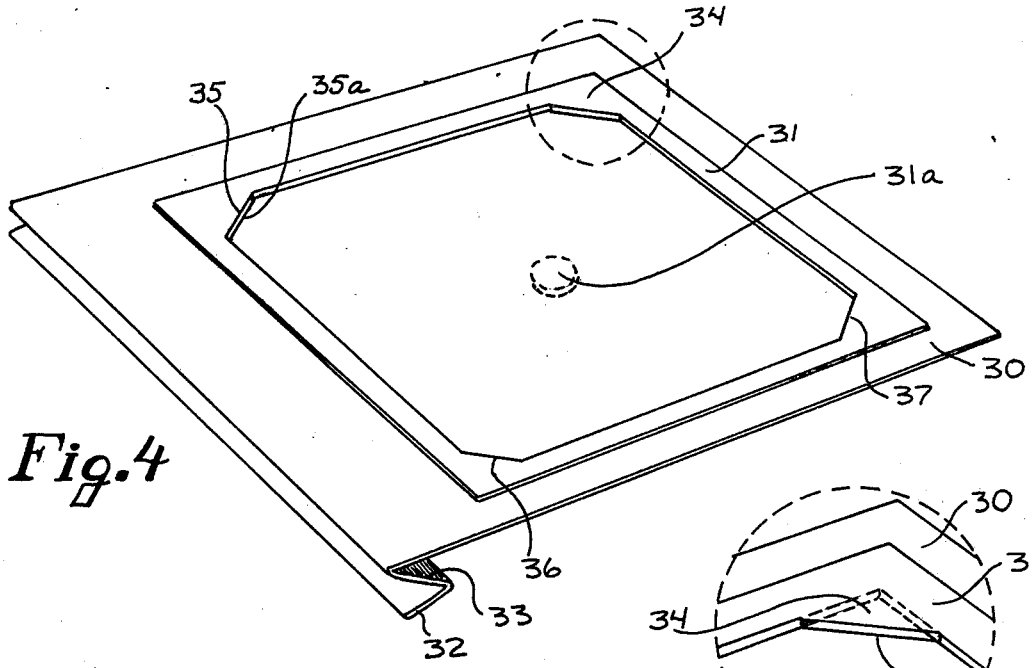
FIG. 4 is a perspective of a page suitable to form the album of FIG. 1 utilizing a method of holding the photos to the page by means of its corners.
Figure 5:
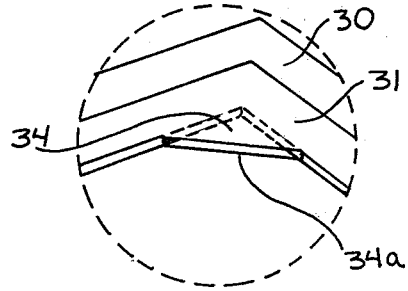
FIG. 5 is an enlarged perspective of one of the corners for holding the photographs on the page such as is illustrated in FIG. 4.

With attention directed particularly to FIG. 4, a page 30, in many ways very similar to the page shown in FIG. 2 and 3, is seen to include an embossed frame area 31, the spaced folding arrangement at the binding 32 and 33, and the additional feature of corners 34, 35, 36 and 37, as a part of the embossing. Each of the corners is cut on the edge of the embossing as particularly illustrated in FIG. 5. It will be observed that the embossed corner 34 is cut at 34*a*. Likewise, the corner 35 and the corners 36 and 37 will be so cut. The slit thus provided, becomes an area of the exact proper size so that one corner of a rectangular photograph will slip within each of the four corners thus cut. As an additional feature, heat melt, paper release, or other, adhesive, may be provided at 31*a* in order to provide for further adhesive of the photo in the center and will avoid a possibility that in the handling of the album the corners of the photo may become loose; Thus, the adhesive will assist in holding the photo in place.

Figure 6:
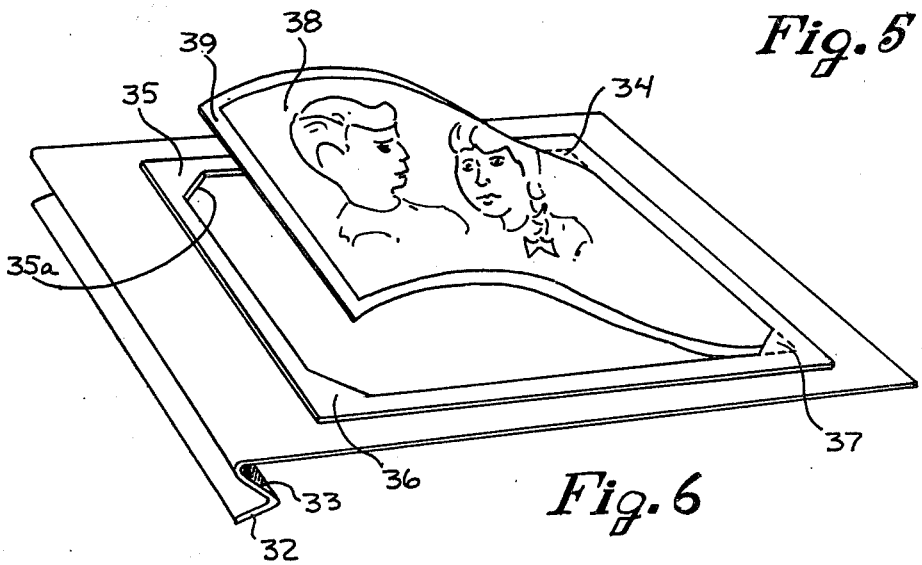
FIG. 6 is a perspective of a page such as in FIG. 4 showing a photograph being inserted in position.

In FIG. 6 the manner in which this is accomplished is well illustrated, and particularly it will be observed that two corners have already been inserted as shown in FIG. 6, and the corner 39 is now ready to be slipped into the cut slot of 35*a*.

When the photo has been thus mounted, it is easily removable for those cases where one wishes a photo to be removed by merely slipping the corners out and removing the photograph. The binding and the spacing of the folded area 32 and 33, it will be clear, is similar to the binding of the embodiments shown in FIGS. 2 and 3.

Figure 7:
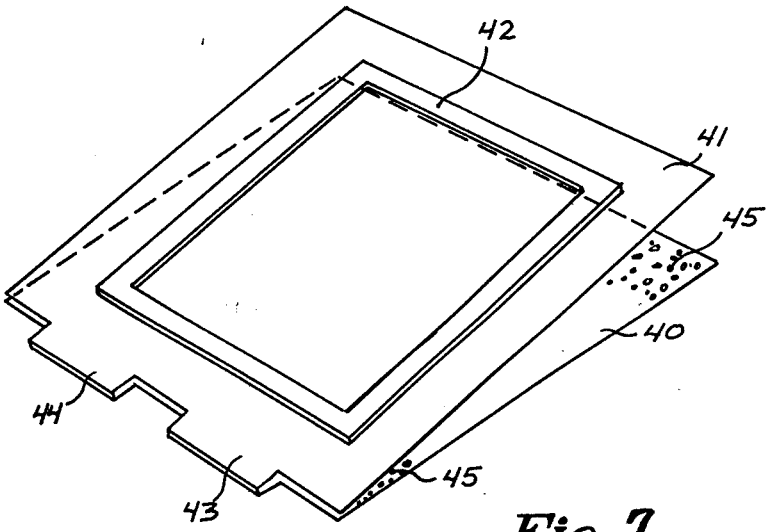
FIG. 7 is a perspective of a double sided page for a different type album but yet to still practice the method of this invention.
Figure 8:
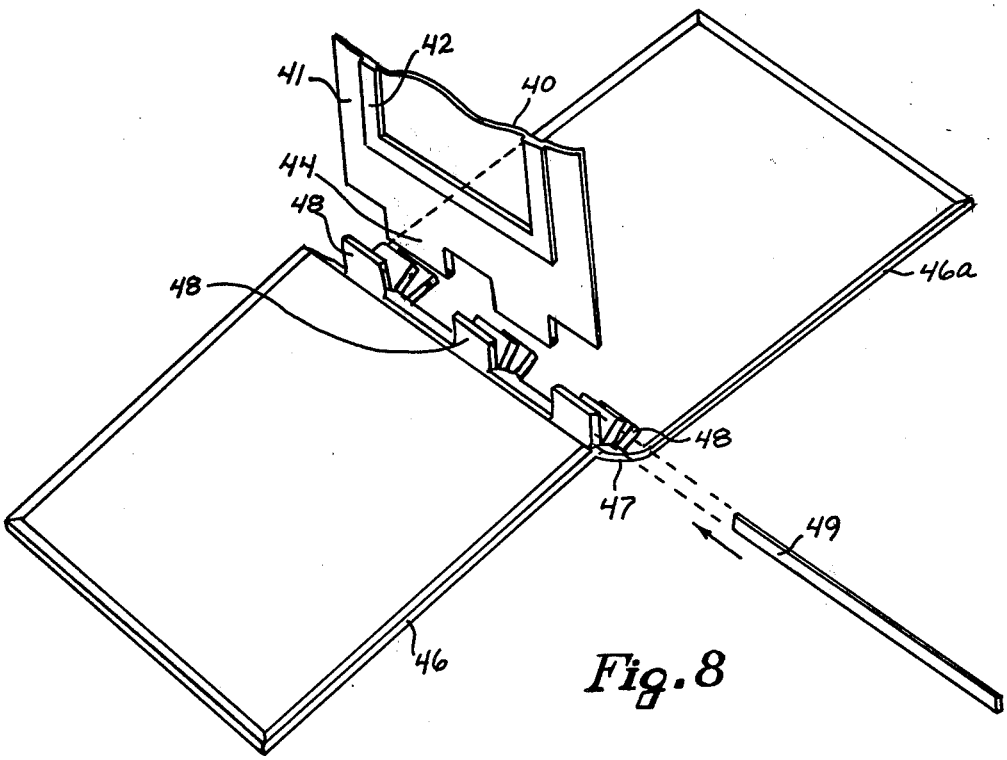
FIG. 8 illustrates a page such as shown in FIG. 7 being inserted within an album suitable to form an album of proper configuration according to a method of this invention.

With attention directed to FIGS. 7 and 8, there is illustrated another unique means by which the method of this invention may be accomplished. In this case, a double page is formed consisting of the pages 40 and 41 folded as indicated along the tabs 43 and 44, and having appropriate embossed area 42 for the proper mounting of the photo according to any of the methods heretofore described or hereafter described.

It will be observed that hot melt glue, release paper adhesive, or the like, 45 is provided along a portion, or all, of the surface of one or both sides of pages 40 and 41 which face one another. In this manner the page may be sealed, as will be necessary for the best mounting as is illustrated in FIG. 8.

When the two pages have become sealed together, the tabs at 43 and 44 become, in essence, loops as will be clear, particularly in FIG. 8.

The binder in which these pages may be mounted will comprise covers 46 and 46*a* joined by backing 47 and containing a series of loops 48, formed of paper or the like, and spaced in such manner as to accommodate between adjoining loops the individual pages 40–41.

It will be clear that when a page 40–41 is placed in position within the cover with tabs 43 and 44 intermediate loops 48, that a strip of plastic, heavy paper, or the like 49, will slide through the loops and thus removably engage the page in position within the binder.

An important feature of our method is always the appropriate spacing so that the album maintains a uniform thickness when fully filled with pictures. It will be observed that the tabs 44 and 43 as well as the tabs 48 have been carefully constructed so as to provide a bending of an essentially square corner at their engaging ends and thus provide spacing which would not be necessarily found if a single bend were made at the fold position. By the rigidity of this square bending, it will be observed that the spacing is accomplished which is necessary to accomplish the end result of the method.

Figure 9A:
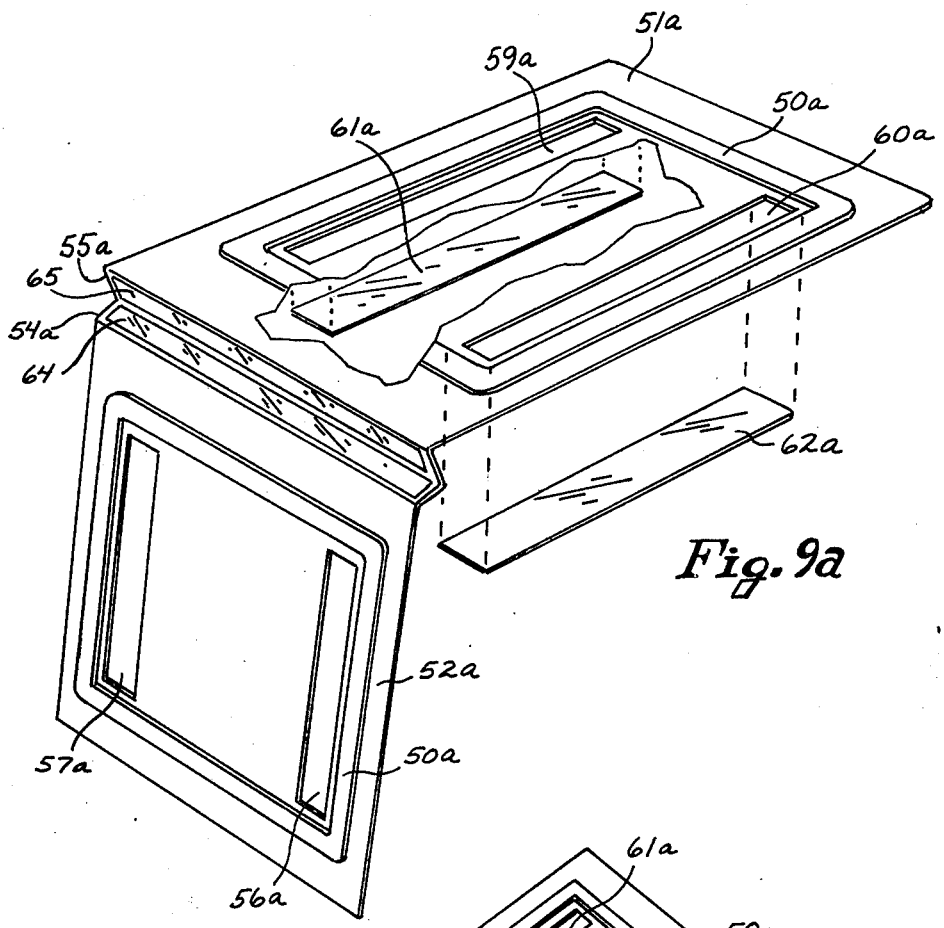
FIG. 9*a* is an alternate form of a double sided page such as that illustrated in FIG. 9 but with a different binding.
Figure 9B:
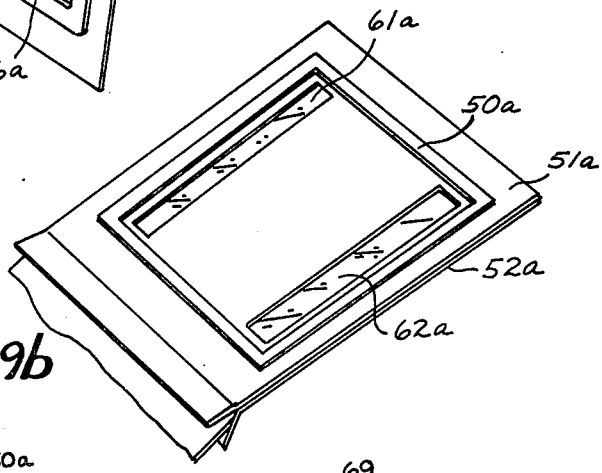
FIG. 9*b* is a reduced scale perspective of the embodiment of FIG. 9*a* when sealed together.
Figure 9D:
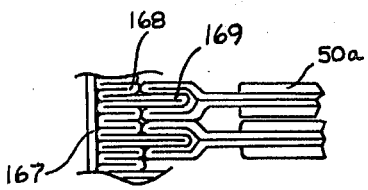
FIG. 9*d* is a partially enlarged side view of an alternate embodiment of the binding area of a page as illustrated in FIG. 9*b;*
Figure 9C:
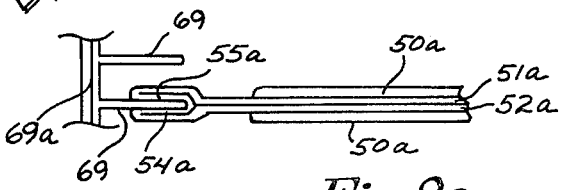
FIG. 9*c* is a partially enlarged side view of the binding area of a page as illustrated in FIG. 9*b;*
Figure 9:
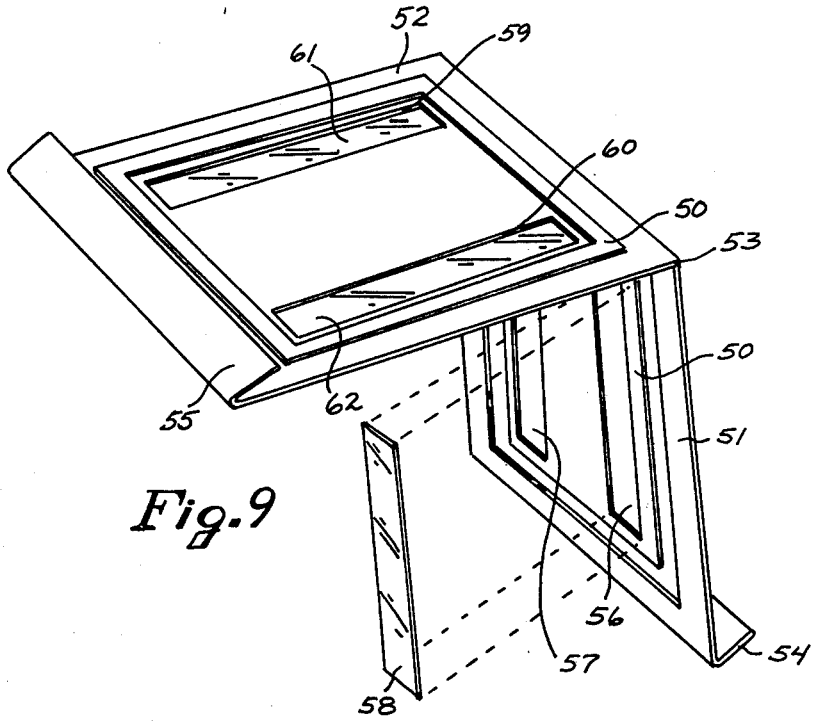
FIG. 9 is a perspective of an alternate form of a double sided page suitable to hold photos in the manner of this invention.
Figure 10:
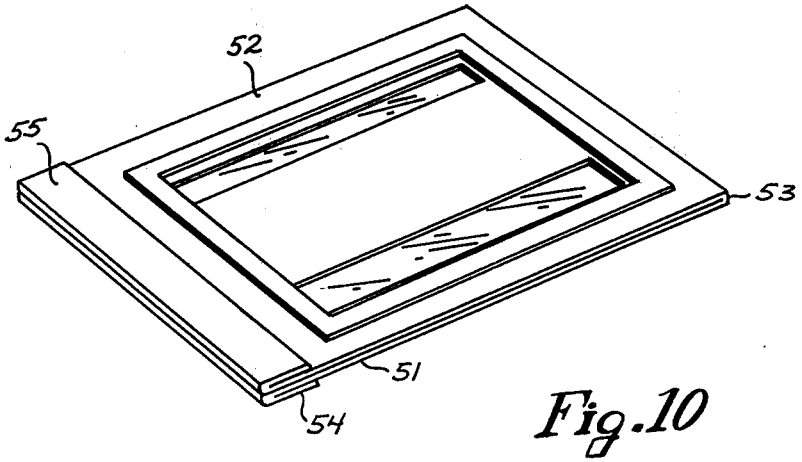
FIG. 10 is a perspective of the same page as FIG. 9 showing the page folded and as it is within the album.

FIGS. 9 and 10 illustrate another unique method of specially folding a single sheet of paper to provide a single or double mounting page suitable to practice the method of this invention. The overall folded page is comprised of the two portions 51 and 52 bent or folded at the edge 53, and with the folded ends 54 and 55 appropriately to provide the desired thickness at the binding edge. The binding edge will be the edge 54 and 55.

The embossing 50 will be provided in the manner heretofore described on each side 51 and 52 so as to form a frame on both of the outer sides of the folded page. These pages may well be utilized by having cutout slots as at 56 and 57, and 59 and 60, with appropriate single, or double sided tape such as 58, 61 and 62 if desired. It is clear that photos placed within the embossed areas will be pressed against the adhesive through the slots and will thus be held in place. Where double sided adhesive tape is used, it will, also, hold the two pages together. Likewise, other adhesive means, such as hot melt adhesive glue or the like may be utilized if desired to hold the two folded pages firmly together. This will be understood by those skilled in the art.

It should also be noted, that the embodiments shown in FIGS. 9 and 10 may be utilized by having the slots to accommodate the adhesive tape upon one side of the page only, and that the other side may be left without the slots. Thus this single page could provide for one side mounting, or one side mounting by adhesive strips through slots as mentioned with the other side to be mounted in one of the many other ways heretofore described.

It should be quite clear that the mountings upon the two sides of a page such as shown in FIGS. 9 and 10 could incorporate any of the methods indicated in FIGS. 2, 2*a*, 2*b*, 2*c*, 4, or the like, without limitation.

FIGS. 9*a*, 9*b*, and 9*c*, illustrates a folded page having some of the characteristics of the page of FIG. 9 but providing for a unique binding arrangement. In the embodiment shown in FIGS. 9*a*, 9*b*, and 9*c*, it is noted that an elongated sheet of paper has once again been so formed as to provide two basic pages 51*a* and 52*a* with a special folding at 54*a* and 55*a*. The embossed area 50*a* provides the frame area for each of the photos in a manner similar to that previously described in connection with the embodiment of FIG. 9. Slots have been provided at 56*a*, 57*a*, 59*a*, and 60*a*, in a manner similar to the corresponding slots in the embodiment described in detail of FIG. 9. Adhesive strips 61*a* and 62*a* may be utilized, once again in the manner as described in connection with the description of FIG. 9. These adhesive strips, if double sided, will serve to hold the pages 51*a* and 52*a* together, or separate adhesive means may be provided if desired, as previously mentioned, to hold said pages together. A most interesting feature of this particular configuration and embodiment is indicated at the special fold area 54*a*–55*a*. It is noted that an adhesive material 64 is attached to the fold portion 54*a* and an adhesive material 65 is affixed to the fold portion 55*a*. With this adhesive, which may be a paper release adhesive, wherein the paper is peeled off immediately prior to the desired adhesion, the binding result shown most clearly in FIG. 9*c* is easily achieved. When the adhesive is exposed, the folded portions 55*a* and 54*a* can be made to adhere firmly to a strip of paper or the like 69. Such strip may be a tab extending from the edge of a binding 69*a*. In the particular illustration if FIG. 9*c*, one tab is shown to which one of the pages has been adhered, and another tab is shown in the approximate location where it would accommodate a like page. It is understood that such tabs could be mounted in a binding edge 69*a* with any reasonable number being provided, and having suitable space between them to provide for the appropriate thickness. FIG. 9*d* shows an alternative to that of FIG. 9*c* where tabs 169 are spaced by folded paper tabs 168 along the binder edge 167.

Figure 11:
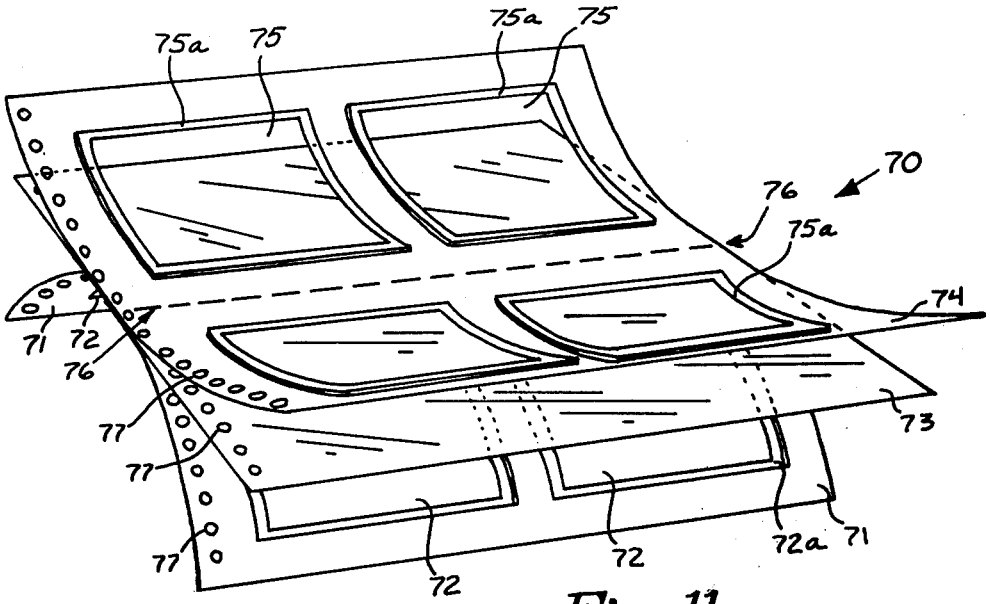
FIG. 11 is a perspective of a special type page, prior to final mounting of photos therein, and for use in a ring binder; and, FIG. 12 is a view of an alternate embodiment of the page of FIG. 11.
Figure 12:
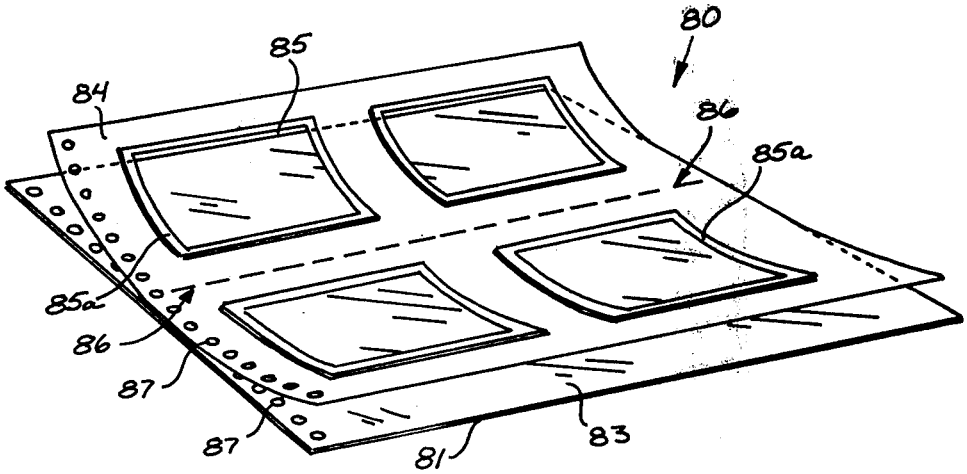

FIGS. 11 and 12 illustrate another unique page, particularly adapted to commercial applications in the mounting of photos within individual album pages. For commercial use, ring type binding pages are frequently used, and the embodiment of FIGS. 11 and 12 is particularly adapted for this use. It now provides a unique method by which rapid, and automated loading of photographs within commercial pages may be accomplished.

With particular attention directed first to FIG. 11, it is seen that the overall page 70 comprises a pair of identical pages 71 and 74, with an intermediate lining 73 of a glassine material or the like having hot melt adhesive applied to both sides. It will be observed that the page 71 has a multiple number of embossed areas for the receiving of the photos, which areas are cut out in the center. This is particularly true as shown by the cut-out areas 72, and the embossed areas 72*a* on page 71, and the cut-out areas 75. with embossed areas 75*a* on page 74. It will be observed that the page portions 71, 73 and 74, each are provided with aligning holes 77 for appropriate ring binding. The three elements are initially provided sealed together along the line 76 such as by heat sealing. Thus they are provided all in condition for utilization.

The photos are now easily inserted within the embossed areas from both sides, by hand, or by machine loading, and in each case the back side of the photo will be appropriately against the glassine and it will be centered and held essentially in place by the embossed area which surrounds the edge of the photo. When the photos have been thus inserted, the entire page is then heat sealed so as to hold the photos appropriately in alignment within their embossed areas and to hold the page as one unitary page. The pages then may be bound by utilization of the rings and ring bindings through the holes 77.

FIG. 12 shows the same identical arrangement as FIG. 11, except that the lower page 81 is a plain sheet of paper and the glassine sheet or the like is adhered thereto. The upper page 84, only, has the openings 85, with the embossed areas 85*a* to receive the pictures. The page is initially sealed along the line 86 by heat sealing or the like. All portions of the multiplicity of pages required to make one page are provided with aligning holes 87 so that when the entire unit is sealed together it may be easily held by ring binding.

In the embodiment of FIG. 12 it should be understood that, if desired, the glassine sheet may be eliminated, and the plain sheet of paper 81 may have a coating of heat melt glue or the like provided thereto. Otherwise, this will be handled in the same manner as previously described.

In this case, page 81 is a plain sheet of paper, as mentioned, and thus a single sided page of photos is provided.

In FIGS. 11 and 12 the pages are shown to contain four pictures on each side in the embodiment of FIG. 11 and four on the one side in the embodiment of FIG. 12. This is not a magic number, and it is understood that any desired number, within reason, would be mountable in this manner. It is also to be understood that a page might contain different size embossed areas for different size prints where it is desired to have more than one different size photographs appear upon one page.

It is to be observed that the mounting in the embodiments of FIG. 11 and FIG. 12 may be by means such as that utilized in U.S. Pat. No. 2,963,809, or by any of the other methods for sealing such pages together which might be known to those skilled in the art. The invention is particularly characterized by the use of the embossed areas in the combination as set forth and the method of providing the photographs as described.

While the embodiments of this invention shown and described are fully capable of achieving the objects and advantages desired, it is to be understood that such embodiments are for purposes of illustration only, and not for purposes of limitation.

We claim:

1. The method of forming a photo album which will maintain the same thickness with or without photos inserted therein comprising: (1) forming a plurality of pages for a photo album; (2) forming a thickened binding edge upon each of said pages by means of folding at said binding edge; (3) forming a locating area for each photo by embossing an area suitable to accommodate said photo, said embossing being of a thickness greater than the thickness of a photo, said embossing being of a thickness comparable to the enlarged thickness at the binding edge so that the photo album will maintain the same thickness even when filled with photos; adhesive means at each locating area so as to hold each photo in place; and, (4) binding a plurality of said pages within a binder at said binding edge.

2. The method of claim 1 wherein each of said embossed areas is provided with a diagonal embossing across each corner, and each such diagonal area is cut so as to be capable of receiving a corner of a photograph.

3. The method of claim 1 in which said fold is made with square corners so as to provide a thickness thereto.

4. The method of claim 3 wherein said fold is at the binding edge of a double sided sheet.

5. The method of claim 4 wherein said folded edge is cut so as to provide alternate loops on the page, and wherein a binder cover is provided with mating loops and a means to engage the mating loops with the said page loops.

6. The method of claim 4 wherein the said fold is a double fold provided with adhesive material and a matching binder having tabs suitable to receive said double fold and be engaged by said adhesive material is provided.

* * * * *